US007083552B2

(12) United States Patent
Carter

(10) Patent No.: US 7,083,552 B2
(45) Date of Patent: Aug. 1, 2006

(54) WEIGHTLIFTING MACHINE WITH DEAD MAN GRIP

(75) Inventor: Kenneth Carter, Clermont, CA (US)

(73) Assignee: Task Industries, Inc., Pomona, CA (US)

( * ) Notice: Subject to any disclaimer, the term of this patent is extended or adjusted under 35 U.S.C. 154(b) by 198 days.

(21) Appl. No.: 10/785,875

(22) Filed: Feb. 23, 2004

(65) Prior Publication Data

US 2005/0187078 A1 Aug. 25, 2005

(51) Int. Cl.
*A63B 21/06* (2006.01)
*A63B 21/068* (2006.01)
*A63B 21/08* (2006.01)

(52) U.S. Cl. ..... 482/93; 482/94; 482/97

(58) Field of Classification Search ..... 482/93, 482/92, 97, 101, 135, 137
See application file for complete search history.

(56) References Cited

U.S. PATENT DOCUMENTS

| | | | | | |
|---|---|---|---|---|---|
| 4,253,662 | A | | 3/1981 | Pokolak | 272/123 |
| 4,333,644 | A | | 6/1982 | Lambert, Jr. et al. | 272/118 |
| 4,357,010 | A | * | 11/1982 | Telle | 482/97 |
| 4,549,734 | A | * | 10/1985 | Hibler et al. | 482/135 |
| 4,563,003 | A | * | 1/1986 | Bugallo et al. | 482/100 |
| 4,564,194 | A | | 1/1986 | Dawson | 272/123 |
| 4,730,829 | A | * | 3/1988 | Carlson | 482/5 |
| 4,771,148 | A | | 9/1988 | Bersonnet | 200/61.58 |
| 4,998,721 | A | | 3/1991 | Anders et al. | 272/118 |
| 5,336,148 | A | * | 8/1994 | Ish, III | 482/98 |
| 5,468,203 | A | | 11/1995 | Okonkwo | 482/104 |
| 5,529,558 | A | * | 6/1996 | Koenig | 482/97 |
| 5,626,548 | A | | 5/1997 | Coyle | 482/137 |
| 5,669,859 | A | * | 9/1997 | Liggett et al. | 482/94 |
| 5,702,329 | A | * | 12/1997 | Koenig | 482/97 |
| 5,716,306 | A | | 2/1998 | Gallay | 482/104 |
| 5,776,084 | A | | 7/1998 | Wolan | 601/26 |
| 6,293,892 | B1 | | 9/2001 | Slawinski et al. | 482/104 |
| 6,623,409 | B1 | | 9/2003 | Abelbeck | 482/104 |
| 2004/0002410 | A1 | * | 1/2004 | Steinbach et al. | 428/121 |

FOREIGN PATENT DOCUMENTS

| | | |
|---|---|---|
| WO | WO 01/15780 | 3/2001 |

* cited by examiner

*Primary Examiner*—Steve Crow
*Assistant Examiner*—Arun Chhabra
(74) *Attorney, Agent, or Firm*—Cislo & Thomas, LLP

(57) ABSTRACT

A safety mechanism for weightlifting devices checks the uncontrolled descent of weights and/or other structures. Using aligned or other slots, a pawl or dog is biased against the surface containing such slots. In order to operate the weightlifting device, the pawl or dog must be actively disengaged from the slots. Exercise can then occur. However, should the weightlifter's grip relax and release the release lever, the associated biasing system forces the engagement end of the dog into one of the aligned slots halting the further downward travel of the associated weights in supporting structures. An associated weightlifting device is disclosed having a latching mechanism enabling securement of the device in a lowered position.

7 Claims, 2 Drawing Sheets

WEIGHTLIFTING MACHINE WITH DEAD MAN GRIP

COPYRIGHT AUTHORIZATION

Portions of the disclosure of this patent document may contain material which is subject to copyright and/or mask work protection. The copyright and/or mask work owner has no objection to the facsimile reproduction by anyone of the patent document or the patent disclosure, as it appears in the Patent and Trademark Office patent file or records, but otherwise reserves all copyright and/or mask work rights whatsoever.

BACKGROUND OF THE INVENTION

1. Field of the Invention

This invention relates to safety devices for weightlifting machines and more particularly to a "dead man" device that prevents the exercise weights from traveling downward should the weightlifter's grip become slack due to fatigue or otherwise.

2. Description of the Related Art

Weightlifting machines are known in the art and are generally meant to complement the use of free weights in directing exercise stress towards a specifically-chosen group of muscles. Many manufacturers currently make weightlifting machines for use in home, public gyms, and the like. Weightlifting has become a popular activity accompanying the rise of greater interest in health and fitness.

Often, and particularly with free weights, an individual may engage in free weight exercise in the company of a second individual known as a "spotter." The spotter assists the weightlifter by allowing the weightlifter to exercise to fatigue and even to the point when the weightlifter can no longer lift the weight. At that point, when the weightlifter has so thoroughly exercised his or her muscles that they can no longer lift the weight, the spotter is able to assist by taking hold of the weight and holding it for the weightlifter. In this way, the weightlifter does not have to allow the weights to drop to the floor (possibly causing a dangerous condition or injury) and the weightlifter is secure that he or she can exercise to thorough fatigue (and thereby achieve a better workout) with the piece of mind of knowing that the weights will not be neglected and uncontrollably fall to the ground.

With free weights, spotters can easily position themselves as there are no obstructions or obstacles to their positioning themselves with respect to the weightlifter. However, this is generally not the case with weightlifting machines. Weightlifting machines often focus on a specific group of muscles and require certain structures such as lever arms, articulating members, cams or gears, or the like, in order to focus the weight on the selected muscle group. This can present a problem as the weightlifter may no longer be able to exercise to fatigue as it may cause him or her to uncontrollably drop the weights possibly causing injury to the weightlifter or another. Attempts have been made in the past to remedy this situation without great success. As a result, it is uncommon to see weightlifting machines with structures, devices, or features that enable the weightlifter to "self-spot" or otherwise prevent the uncontrollable descent of weights in conjunction with the weightlifting machine.

SUMMARY OF THE INVENTION

In view of the foregoing disadvantages inherent in the known types of weightlifting machines and the like now present in the prior art, the present invention provides a dead man grip mechanism that provides self-spotting and the like wherein a weightlifter can exercise to fatigue and be assured that the weights will not uncontrollably fall to the ground as the weightlifter must actively prevent engagement of the dead man or self-spotting device in order to use the machine.

The general purpose of the present invention, which will be described subsequently in greater detail, is to provide better safety and security for weightlifters who might be frail and require immediate assistance would the weights be too burdensome and/or provide a self spotting device so should the weightlifter slip or exercise to fatigue, the immediate loss of support from the weightlifter or the weights is remedied by a mechanism that prevents the weights from dropping uncontrollably. By providing such a dead man device for weightlifting machines, a new safety system is provided which has many of the advantages of prior systems and many new and novel features which are not anticipated, rendered obvious, suggested, taught, or even implied by any of the prior art systems or devices, either alone or in any combination thereof.

The weightlifting machine with dead man grip that is set forth herein provides means by which the weightlifter can quickly relieve him or herself of the burden of the weights while exercising. This is particularly important if for some reason the weightlifter is overcome by the weights and must quickly disengage them. A pole, post or other upstanding member has a series of aligned holes or other structures that are able to engage a dog or pawl. The pawl is biased such that it naturally fits into one of the aligned slots and is coupled to the motion of the weights, generally in a vertical (up and down) disposition.

A release handle overcomes the biasing of the dog and enables the weights to travel freely about their generally predetermined range of motion. Generally, manual engagement of the release lever enables it to retract the dog from the aligned slots or holes to free the weights for exercise. However, should the weightlifter's grip relax, the dog or pawl is once again subject to the unrestrained biasing it experiences by default. The downward travel of the weights causes the dog to fit into one of the aligned slots, if it does not do so immediately, as the downward travel of the weights causes the dog to move along the upstanding member until it meets one of the aligned slots.

A number of weightlifting devices and machines can incorporate the dead man grip system set forth herein. As shown in the Figures, one such machine is for the general exercise of the lower extremities, generally the hips and thighs. By engaging the weights with the shoulders after placing the feet on a footplate, the weightlifter engages handles associated with the exercise weights. The weightlifter's grasp naturally engages the retraction lever in order to withdraw the dog from one of the aligned slots. The exerciser is then free to engage in the squatting-standing repetitions as the intended exercise provided by the machine. However, the dead man grip system set forth herein would also be adaptable to upper body exercising systems, torso exercising systems, and generally any vertical and horizontal exercising system such that the weights are biased in a certain direction and relief can be provided for the weightlifter by releasing his or her grip on a retraction handle or other activation device.

In one embodiment, the weightlifting safety system set forth herein includes a safety mechanism for a weightlifting system that has an upwardly-projecting extension defining a series of aligned apertures. These aligned apertures enable a pawl to retractably fit into any one of said aligned apertures. The pawl is biased towards said upwardly-projecting extension and prevents downward movement of the weightlifting system when fitted into one of the aligned apertures. The safety system also has a retraction lever enabling retraction of the pawl away from the upwardly-projecting extension and allowing free motion of the weightlifting system. The retraction lever is engageable by a weightlifter to retract the pawl from the upwardly-projecting extension.

In another embodiment for the weightlifting system, a safety mechanism prevents the free fall of weights used in the weightlifting system. The safety mechanism includes an upwardly-extending projection having a series of aligned holes or slots into which a dog or pawl may fit. The dog has a release or retraction lever and is biased towards the upwardly-extending projection. The retraction lever makes the dog retractable by a weightlifter using the weightlifting system such that when the release lever is released by the weightlifter, the biasing of the dog against the upwardly extending projection coupled with descent of the dog caused by the weights causes the dog to engage one of the aligned holes to thereby stop the further descent of the weights.

In another embodiment, a safety mechanism for a weightlifting system has an extension or surface defining a series of aligned apertures. A pawl retractably fits into any one of the aligned apertures, the pawl being biased towards the extension or surface. The pawl prevents movement of the weightlifting system in a selected direction when fitted into one of the aligned apertures. The pawl is generally coupled to accompanying structure of the weightlifting system that is itself separately biased (as by gravity, an elastic band, or otherwise) to travel in a certain direction. A retraction lever enables retraction of the pawl away from the extension or surface and allows free motion of the weightlifting system, the retraction lever being engageable by a weightlifter to retract the pawl from the extension or surface.

OBJECTS OF THE INVENTION

It is an object of the present invention to provide a better safety mechanism for weightlifting devices.

It is yet another object of the present invention to prevent the freefall of weights in weightlifting machines by providing a fail-safe or dead man feature such that active operation by the weightlifter must occur in order to free the weights for use and which by default automatically hold the weights in place or limit their downward or uncontrolled travel when active operation is removed or ends.

It is yet another object of the present invention to provide a safety mechanism for weightlifting machines which prevents the uncontrolled descent of associated weights.

It is yet another object of the present invention to provide a dead man feature for weightlifting machines that is easy to use and easy to construct.

These and other objects and advantages of the present invention will be apparent from a review of the following specification and accompanying drawings. The foregoing objects are some of but a few of the goals sought to be attained by the present invention.

DESCRIPTION OF THE PREFERRED EMBODIMENT(S)

Figure 1:
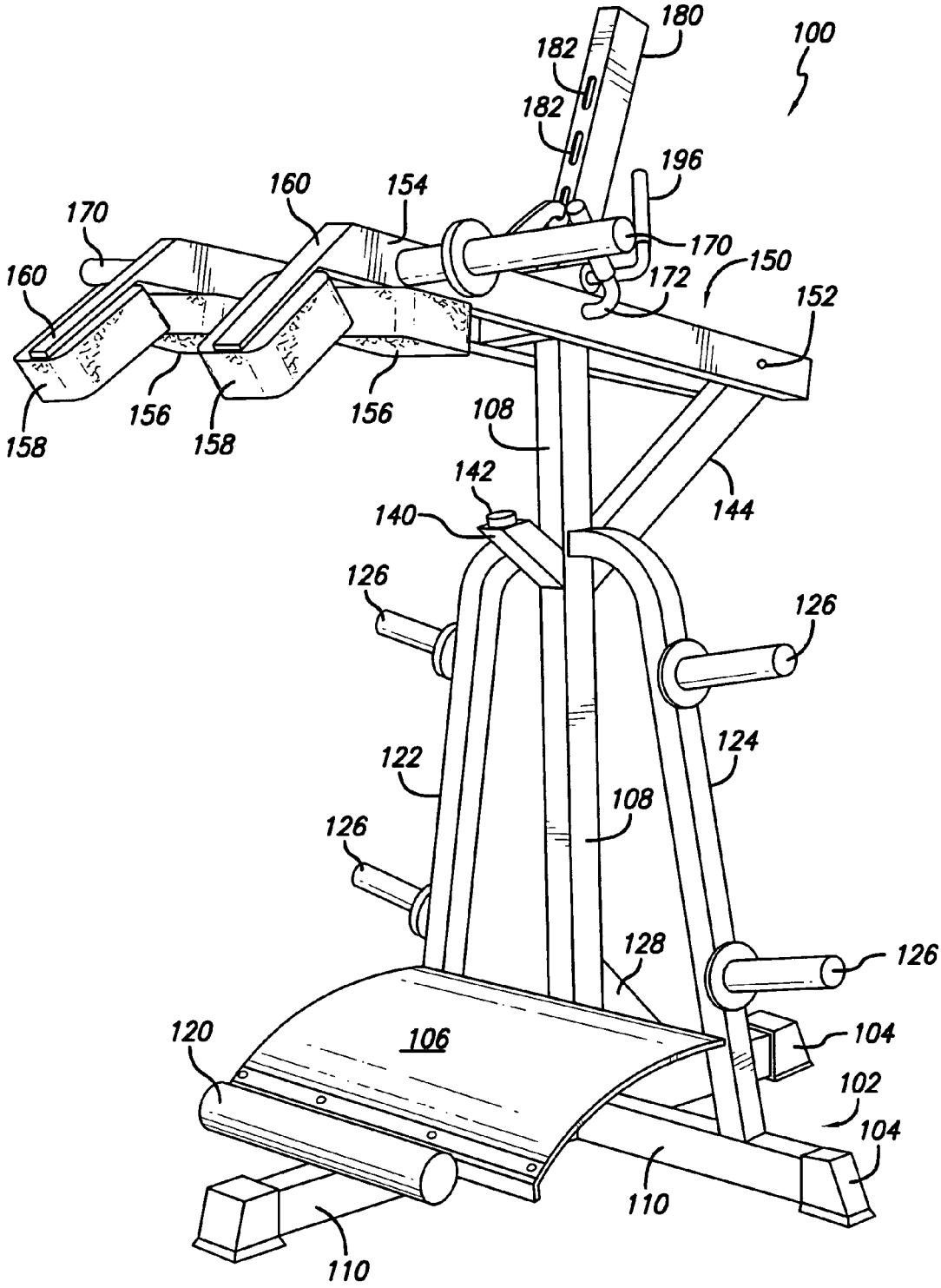
FIG. 1 is a right rear elevational view of a weightlifting device incorporating the safety mechanism of the present invention.

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Referring to the drawings where like numerals of reference designate like elements throughout it will be noted that in one embodiment, a weightlifting machine 100 is directed for exercise of muscle groups generally along the hips and thighs. The exercise machine 100 enables the weightlifter to engage shoulder and shoulder blade pads while standing on a footplate in order to squat and extend thereby exercising the hips and lower extremities.

In FIG. 1, the weightlifting machine 100, has a base 102 in generally the form of a cross or X. The distal ends of the base 102 end in feet 104 which serve to securely and generally in a non-skid manner engage the floor. The base 102 supports a footplate 106 and a central post 108. A central post 108 may be attached to the base 102 at an intersection of the legs 110 of the base. The footplate 106 may be curved in order to provide different angular dispositions for the weightlifter and so that he or she may better engage the upper portion of the weightlifting machine 100 about which more is described in detail below.

The footplate 106 may have at its rear end a tube 120 or other structure which acts as a calf-raise bar. The calf raise bar 120 provides support for use in calf raise exercises. When performing calf-raise exercises, the user places the front part of his foot or feet on to the tube/calf-raise bar 120 while standing in an upright position. As set forth in more detail below, the shoulder-engaging mechanism rests upon the exerciser's shoulders and the exerciser raises himself or herself up onto the toes as far as possible against the resistance of the weight and into a tip toe position. This motion is generally effected by articulation of the foot and calf muscles about the ankle. This exercises and/or stretches the calf muscles in order to provide development thereof.

While possibly adjustable, the calf-raise bar 120 may be set upon the adjoining leg 110 of the base 102 in a fashion that provides for a ubiquitous use by persons having a variety of foot sizes. The calf-raise bar 120 may also act as a heel stop that serves as a tactile reminder to the weightlifter or other person that is standing on the footplate 106 that they are about to rearwardly depart from the footplate 106 and travel onto the floor.

The central post 108 may be flanked on either side by support posts 122, 124 the support posts 122, 124 may be oppositely opposed and have weight posts 126 projecting laterally and preferably upwardly therefrom so that gravity generally biases any weights supported by the weight posts 126 onto the weight posts and toward the support posts 122, 124. A reinforcing member 128 may serve to provide additional support to the central post 108 by providing additional support between the central post 108 and one or more of the legs 110 of the base 102. A small rest support 140 may terminate in a pad or cushion 142. The rest support 140 may be attached proximate to the upper ends of the support post 122, 124 and project rearwardly in order to engage the upper portion of the weight lifting machine 100.

A forwardly extending projection 144 extends away from the viewer in FIG. 1 and generally projects forwardly from the central post 108 on a side of the central post 108 opposite that of the footplate 106. Pivotedly, hingedly, or otherwise enabling a pivoting relationship between itself and the forwardly extending projection 144, a shoulder-engaging mechanism 150 travels radially about its pivot point 152 and along the central post 108.

The shoulder-engaging mechanism 150 has a set of complementary bars or levers 154 which are generally mirror images of one another. Each of the bars or levers 154 extend rearwardly from the pivot point 152 and pass in a symmetrical fashion on either side of the central post 108. The rear termination of the shoulder-engaging mechanism 150 are in sets of pads or cushions. Each of the bars 154 has a shoulder pad 156 and a shoulder blade pad 158. The shoulder pads 156 are generally attached to the underside of each of the bars 154. Extensions 160 project at the appropriate angle downwardly from the bars 154 in order to provide support for the shoulder blade pads 158. The angular relationship between the shoulder pads 156 and shoulder blade pads 158 is so that a weightlifter can engage each as appropriate with the pads engaging the corresponding anatomical structure on the weightlifter about his or her shoulders/shoulder blades.

Each of the bars 154 has a laterally and outwardly projecting weight post 170 upon which free weights, disc weights, or the like can be placed and held in position. These weights serve as the selectably adjustable resistance against which the weightlifter exercises. Additionally, handles 172 enable the weightlifter to manually engage the shoulder-engaging mechanism 150 and provide convenient positioning for the hands as well as a means by which the weightlifter can secure him or herself against the shoulder and shoulder blade pads 156, 158.

Projecting upwardly from the central post 108 is an upwardly-projecting extension 180. In the particular embodiment shown in FIGS. 1–4, the upwardly-projecting extension 180 is angled forwardly at a slight angle to accommodate the radial operation of the shoulder-engaging mechanism 150. The upwardly-projecting extension 180 has a series of aligned slots 182 about which more description is given below. The aligned slots 182 enable the pawl or dog to engage the upwardly-projecting extension 180 and thereby control and end any downward descent of the shoulder-engaging mechanism 150. The slots 182 are generally aligned with the travel of the pawl.

Figure 2:
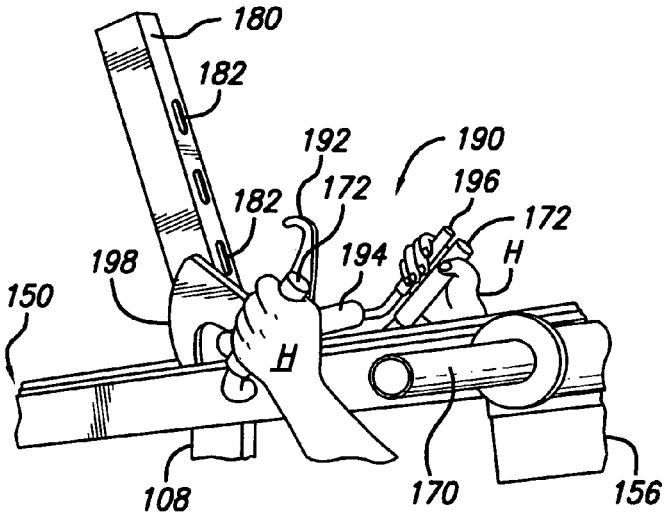
FIG. 2 is a left side rear perspective view of the safety mechanism shown in FIG. 1 with the pawl or dog fully retracted from the upwardly extending projection with its aligned slots.
Figure 3:
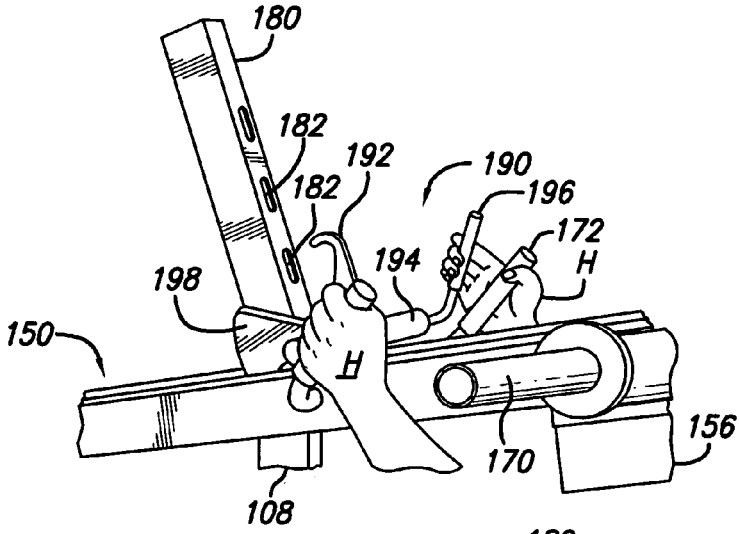
FIG. 3 is a left side rear perspective view of the safety mechanism shown in FIG. 2 with the pawl or dog about to engage one of the aligned slots and the release and retraction lever in a half way position.
Figure 4:
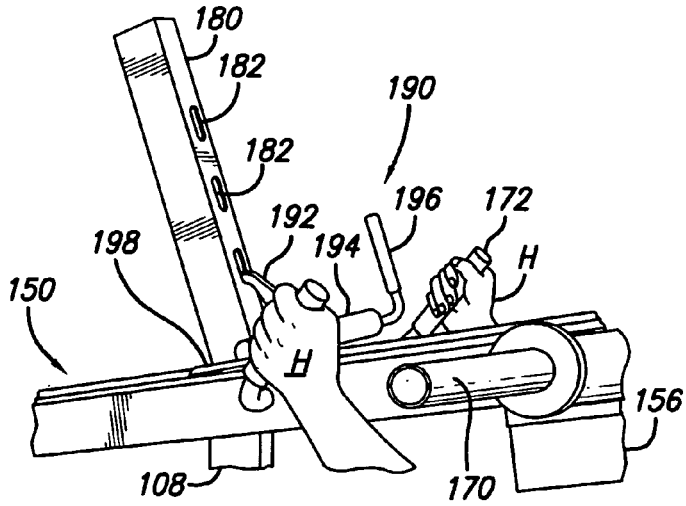
FIG. 4 is a left side rear perspective view of the safety mechanism of FIGS. 2 and 3 with the safety mechanism engaged, the release and retraction lever fully disengaged, and the weightlifter's hands fully engaging the main handles.

FIGS. 2–4 show the safety mechanism 190 of the present system. In FIGS. 2–4, the hands of the weightlifter H have both engaged the handles 172 of the shoulder-engaging mechanism 150. In conjunction with the upwardly-projecting extension 180 with its aligned slots 182, the safety mechanism 190 has a dog or pawl 192 that is of sufficient dimensions so as to fit into any of the aligned slots 182. The dog or pawl 192 is coupled to the shoulder-engaging mechanism by a biasing system 194 which can be a torsion spring or otherwise. The biasing system 194 is coupled to a release or retraction lever 196 which is shown in various degrees of manual engagement in FIGS. 2, 3 and 4.

In FIG. 2, the hand H of the weightlifter has fully engaged the release and retraction lever 196, withdrawing it completely and pulling it back completely from the aligned slots 182 and away from the upwardly-projecting extension 180. In FIG. 3, the weightlifter has engaged the release lever 196, only halfway and the dog 192 is adjacent to the upwardly-projecting extension, but not within any of the aligned slots 182. In FIG. 4, the weightlifter has completely released the release lever 196 and the pawl 192 has engaged the upwardly-projecting extension 180 via one of the aligned slots 182.

The dog 192 generally has a hooked end so as to engage the upwardly-projecting extension 180. The biasing system 194 serves to urge the dog 192 toward the upwardly-projecting extension (or upwardly-extending projection) 180 in a fashion such that travel of the dog or pawl up vertically (as by the raising or lowering of the shoulder-engaging mechanism 150) causes the dog 192 to be forced into the first available aligned slot 182.

As a result, it can be seen that once the weightlifter releases the retraction lever 196, the biasing system 194 forces the pawl against the upwardly-projecting extension. As the shoulder-engaging mechanism travels either upward or downward, the dog 192 slides along the upwardly-projecting extension 180 until it meets one of the aligned slots 182. Upon meeting an aligned slot 182, the biasing system 194 forces the hooked end or engagement end of the dog 192 into the aligned slot. If the shoulder-engaging mechanism 150 is traveling upward, such upward travel will be halted as the dog 192 engages the upper part of the aligned slot 182. If the shoulder-engaging mechanism 150 is traveling downward (as may happen should the weightlifter slip, fall or otherwise with the accompanying release of the release lever 196), the pawl 192 will slide downwardly along the upwardly-projecting extension 180 until it meets an aligned slot 182. At that point, the biasing system 194 pushes the engagement end of the dog 192 into the aligned slot which then comes into contact with the lower end of the aligned slot 182, halting the downward progress of the shoulder-engaging mechanism 150 with any and all weights it may have on its weight posts 170.

Due to the foregoing, the safety mechanism 190 in the present weightlifting device can be applied not only to the embodiment shown in the Figures but to a variety of other embodiments in either vertical or horizontal geometries and/or construction.

For example, in another embodiment, a safety mechanism for a weightlifting system has an extension or surface defining a series of aligned apertures. A pawl retractably fits into any one of the aligned apertures, the pawl being biased towards the extension or surface. The pawl prevents movement of the weightlifting system in a selected direction when fitted into one of the aligned apertures. The pawl is generally coupled to accompanying structure of the weightlifting system that is itself separately biased (as by gravity, an elastic band, or otherwise) to travel in a certain direction. A retraction lever enables retraction of the pawl away from the extension or surface and allows free motion of the weightlifting system, the retraction lever being engageable by a weightlifter to retract the pawl from the extension or surface.

As an additional feature, FIGS. 2–4 show an additional latching mechanism 198 which can be used to secure the shoulder-engaging mechanism 150 into a lowered and secure position.

When the shoulder-engaging mechanism 150 is allowed to descend completely, it is stopped by the rest support 140 with its optional pad or cushion 142. By retracting the release lever 196, the latching mechanism 198 is retracted and the shoulder-engaging mechanism 150 is allowed to completely lower onto the rest support 140. By then releasing the release lever 196, the latching mechanism 198 can then pivot about the central axis of the biasing system 194 in order to engage the left support post 122 near its top. The engagement of the latching mechanism 198 with the left support post 122 prevents the upward motion of the shoulder-engaging mechanism 150 until the release lever 196 is retracted toward the handle 172 and the latching mechanism 198 frees the support post 122.

While the present invention has been described with regards to particular embodiments, it is recognized that additional variations of the present invention may be devised without departing from the inventive concept.

What is claimed is:

1. A safety mechanism for a weightlifting system, comprising:

an upwardly-projecting extension defining a series of aligned apertures;

a pawl retractably fittable into any one of said aligned apertures, said pawl biased towards said upwardly-projecting extension, said pawl preventing downward movement of the weightlifting system when fitted into one of said aligned apertures;

a retraction lever enabling retraction of said pawl away from said upwardly-projecting extension and allowing free motion of the weightlifting system, said retraction lever engageable by a weightlifter to retract said pawl from said upwardly-projecting extension;

a pivoting shoulder-engaging mechanism coupled to said pawl and said retraction lever, said pivoting shoulder-engaging mechanism moveable with respect to said upwardly-projecting extension;

first and second handles coupled to said pivoting shoulder-engaging mechanism for manual engagement by a weightlifter, said first handle proximate said retraction lever for simultaneous manual engagement of both said first handle and said retraction lever by said weightlifter;

a base for supporting the weightlifting system, said base coupled to said upwardly-projecting extension;

a foot plate coupled to said base for engagement by the feet of said weightlifter;

a calf-raise bar proximately adjacent a rear portion of said foot plate;

a central post descending from said upwardly-projecting extension, said central post coupled at an opposite end to said base;

first and second opposing support posts, each opposing support post coupled at first ends to said central post and at second ends to said base;

a forwardly-extending projection coupled at a first end to said central post and pivotingly coupled at a second end to said shoulder-engaging mechanism, said forwardly-extending projection projecting away from said central post a distance that enables said weightlifter to lift weights via said pivoting shoulder-engaging mechanism through a range of motion from squatting to standing; and a latch coupled to and retracting with said pawl, said latch engageable with said first support post when said pivoting shoulder-engaging mechanism is in a lower position, said latch holding said pivoting shoulder-engaging mechanism proximate to said first and second support posts.

2. A safety mechanism for a weightlifting system as set forth in claim 1, further comprising:

a rest support projecting upwardly from said central post and engaging said pivoting shoulder-engaging mechanism when said shoulder-engaging mechanism is in said lower position.

3. A safety mechanism for a weightlifting system, comprising:

an upwardly-projecting extension defining a series of aligned apertures;

a pawl retractably fittable into any one of said aligned apertures, said pawl preventing downward movement of the weightlifting system when fitted into one of said aligned apertures;

a torsion spring coupled to said pawl and biasing said pawl towards said upwardly-projecting extension;

a retraction lever coupled to said torsion spring and enabling retraction of said pawl away from said upwardly-projecting extension and allowing free motion of the weightlifting system, said retraction lever engageable by a weiglitlifter to retract said pawl from any of said aligned apertures;

a pivoting shoulder-engaging mechanism coupled to said pawl, said pivoting shoulder-engaging mechanism moveable with respect to said upwardly-projecting extension;

first and second handles coupled to said pivoting shoulder-engaging mechanism, said first handle proximate said retraction lever for simultaneous manual engagement of both said first handle and said retraction lever by a weightlifter;

a central post descending from said upwardly-projecting extension;

a base supporting said central post at an end of said central post opposite said upwardly-projecting extension;

a foot plate coupled to said base for engagement by the feet of said weightlifter;

a calf-raise bar proximately adjacent a rear portion of said foot plate, said calf-raise bar providing a support for calf-raise exercise and operating as a tactile indication of a rear end of said foot plate;

first and second opposing support posts, each opposing support post coupled at first ends to said central post and at second ends to said base;

a forwardly-extending projection coupled at a first end to said central post and pivotingly coupled at a second end to said shoulder-engaging mechanism, said forwardly-extending projection projecting away from said central post a distance that enables said weightlifter to lift weights via said pivoting shoulder-engaging mechanism through a range of motion from squatting to standing;

a rest support projecting upwardly from said central post and engaging said pivoting shoulder-engaging mechanism when said shoulder-engaging mechanism is in a lower position; and a latch coupled to, and retracting with, said pawl, said latch engageable with said first support post when said pivoting shoulder-engaging mechanism is in said lower position, said latch holding said pivoting shoulder-engaging mechanism proximate to said first and second support posts.

4. In a weightlifting system for exercise, a safety mechanism for preventing free fall of weights used in the weightlifting system, the safety mechanism comprising an upwardly-extending projection having a series of aligned holes or slots into which a dog or pawl may fit, said dog having a release or retraction lever and being biased towards said upwardly-extending projection, but being retractable by a weightlifter using the weightlifting system such that when said release lever is released by the weightlifter, the biasing of said dog against said upwardly extending projection coupled with descent of said dog caused by said weights causes said dog to engage one of said aligned holes, thereby stopping the further descent of the weights, said weights being supported by a pivoting shoulder-engaging mechanism coupled to said dog and said release lever, said pivoting shoulder-engaging mechanism moveable with respect to said upwardly-extending projection;

first and second handles coupled to said pivoting shoulder-engaging mechanism for manual engagement by a weightlifter, said first handle proximate said release lever for simultaneous manual engagement of both said first handle and said release lever by said weightlifter;

a base for supporting the weightlifting system, said base coupled to said upwardly-extending projection;

a foot plate coupled to said base for engagement by the feet of said weightlifter;

a calf-raise bar proximately adjacent a rear portion of said foot plate;

a central post descending from said upwardly-extending projection, said central post coupled at an opposite end to said base;

first and second opposing support posts, each opposing support post coupled at first ends to said central post and at second ends to said base;

a forwardly-extending projection coupled at a first end to said central post and pivotingly coupled at a second end to said shoulder-engaging mechanism, said forwardly-extending projection projecting away from said central post a distance that enables said weightlifter to lift weights via said pivoting shoulder-engaging mechanism through a range of motion from squatting to standing; and a latch coupled to and retracting with said dog, said latch engageable with said first support post when said pivoting shoulder-engaging mechanism is in a lower position, said latch holding said pivoting shoulder-engaging mechanism proximate to said first and second support posts.

5. The safety mechanism for a weightlifting system as set forth in claim 4, further comprising:

a rest support projecting upwardly from said central post and engaging said pivoting shoulder-engaging mechanism when said shoulder-engaging, mechanism is in said lower position.

6. In a weightlifting system for exercise, a safety mechanism for preventing free fall of weights used in the weightlifting system, the safety mechanism comprising an upwardly-extending projection having a series of aligned holes or slots into which a dog or pawl may fit, said dog having a release or retraction lever and being biased towards said upwardly-extending projection, but being retractable by a weightlifter using the weightlifting system such that when said release lever is released by the weightlifter, the biasing of said dog against said upwardly extending projection coupled with descent of said dog caused by said weights causes said dog to engage one of said aligned holes, thereby stopping the further descent of the weights, said weights being supported by a pivoting shoulder-engaging mechanism coupled to said dog and said release lever, said pivoting shoulder-engaging mechanism moveable with respect to said upwardly-extending projection;

first and second handles coupled to said pivoting shoulder-engaging mechanism for manual engagement by a weightlifter, said first handle proximate said release lever for simultaneous manual engagement of both said first handle and said release lever by said weightlifter;

a central post descending from said upwardly-extending projection;

a base for supporting the weightlifting system, said base coupled to said central post;

a foot plate coupled to said base for engagement by the feet of said weightlifter;

a calf-raise bar proximately adjacent a rear portion of said foot plate, said calf-raise bar providing a support for calf-raise exercise and operating as a tactile indication of a rear end of said foot plate;

first and second opposing support posts, each opposing support post coupled at first ends to said central post and at second ends to said base;

a forwardly-extending projection coupled at a first end to said central post and pivotingly coupled at a second end to said shoulder-engaging mechanism, said forwardly-extending projection projecting away from said central post a distance that enables said weightlifter to lift weights via said pivoting shoulder-engaging mechanism through a range of motion from squatting to standing;

a latch coupled to and retracting with said dog, said latch engageable with said first support post when said pivoting shoulder-engaging mechanism is in a lower position, said latch holding said pivoting shoulder-engaging mechanism proximate to said first and second support posts; and a rest support projecting upwardly and rearwardly from said central post and engaging said pivoting shoulder-engaging mechanism when said shoulder-engaging mechanism is in said lower position.

7. A safety mechanism for a weightlifting system, comprising:

an extension or surface defining a series of aligned apertures;

a pawl retractably fittable into any one of said aligned apertures, said pawl biased towards an element selected from a group consisting of said extension and said surface, said pawl preventing movement of the weiglitlifting system in a selected direction when fitted into one of said aligned apertures;

a retraction lever enabling retraction of said pawl away from an element selected from a group consisting of said extension and said surface and allowing free motion of the weightlifting system, said retraction lever engageable by a weightlifter to retract said pawl from an element selected from a group consisting of said extension and said surface, a pivoting shoulder-engaging mechanism coupled to said pawl and said retraction lever, said pivoting shoulder-engaging mechanism moveable with respect to said upwardly-projecting extension;

first and second handles coupled to said pivoting shoulder-engaging mechanism for manual engagement by a weightlifter, said first handle proximate said retraction lever for simultaneous manual engagement of both said first handle and said retraction lever by said weightlifter;

a base for supporting the weightlifting system, said base coupled to said upwardly-projecting extension;

a foot plate coupled to said base for engagement by the feet of said weightlifter;

a calf-raise bar proximately adjacent a rear portion of said foot plate;

a central post descending from said upwardly-projecting extension, said central post coupled at an opposite end to said base;

first and second opposing support posts, each opposing support post coupled at first ends to said central post and at second ends to said base;

a forwardly-extending projection coupled at a first end to said central post and pivotingly coupled at a second end to said shoulder-engaging mechanism, said forwardly-extending projection projecting away from said central post a distance that enables said weightlifter to lift weights via said pivoting shoulder-engaging mechanism through a range of motion from squatting to standing; and a latch coupled to and retracting with said pawl, said latch engageable with said first support post when said pivoting shoulder-engaging mechanism is in a lower position, said latch holding said pivoting shoulder-engaging mechanism proximate to said first and second support posts.

* * * * *